US008180015B2

(12) United States Patent
Nalle, III et al.

(10) Patent No.: US 8,180,015 B2
(45) Date of Patent: May 15, 2012

(54) COUNTING DEVICE FOR COUNTING NESTED ARTICLES AND METHOD FOR COUNTING NESTED ARTICLES

(75) Inventors: Thomas A. Nalle, III, Knoxville, TN (US); Donathan Brown, Lenoir City, TN (US)

(73) Assignee: Thomas A. Nalle, III, Knoxville, TN (US)

( * ) Notice: Subject to any disclaimer, the term of this patent is extended or adjusted under 35 U.S.C. 154(b) by 130 days.

(21) Appl. No.: 12/825,401

(22) Filed: Jun. 29, 2010

(65) Prior Publication Data

US 2011/0317801 A1 Dec. 29, 2011

(51) Int. Cl.
*G06M 11/00* (2006.01)
*G06M 7/00* (2006.01)

(52) U.S. Cl. ..... 377/6; 235/425; 235/419; 221/182

(58) Field of Classification Search ..... None
See application file for complete search history.

(56) References Cited

U.S. PATENT DOCUMENTS

| | | | | |
|---|---|---|---|---|
| 3,313,482 | A * | 4/1967 | Midgley et al. | 235/98 R |
| 3,756,371 | A * | 9/1973 | Neil | 414/798.9 |
| 4,545,714 | A * | 10/1985 | Johnson et al. | 414/788.2 |
| 4,805,379 | A * | 2/1989 | Leibetseder et al. | 53/444 |
| 7,153,089 | B2 * | 12/2006 | Wisniewski | 414/797.7 |
| 2002/0186807 | A1 * | 12/2002 | Kozak | 377/8 |

* cited by examiner

*Primary Examiner* — Tuan T Lam
(74) *Attorney, Agent, or Firm* — Pitts & Lake, P.C.

(57) ABSTRACT

A counting device for counting rimmed articles arranged in a nested configuration to define a series of stacked rims defining a stacked direction is disclosed. The counting device has a gear with a plurality of teeth adapted to engage the article rims such that advancement of the articles along the stacked direction adjacent the gear rotates the gear. An indicator wheel is provided configured to rotate with rotation of the gear. The indicator wheel has a plurality of indicia thereon for monitoring rotation of the gear. At least one sensor is positioned to detect the indicia and to generate an output signal as the indicator wheel rotates to bring the indicia into alignment with a detection axis. The sensor is in communication with a counter which produces in response to the output signal of the sensor a usable output representing a quantity of articles having engaged the gear.

20 Claims, 11 Drawing Sheets

COUNTING DEVICE FOR COUNTING NESTED ARTICLES AND METHOD FOR COUNTING NESTED ARTICLES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to methods and devices for counting objects. More particularly, this invention pertains to methods and devices for counting objects in a stream of stacked or nested objects.

2. Description of the Related Art

Containers, container lids, plates, bowls, trays, cups, and other similar articles (hereinafter, collectively, "articles") of the type having a circumferential rim and a depending concave body portion are common mass-produced goods. Such articles are often fabricated from a disposable or semi-disposable material such as paper, plastic, polystyrene, aluminum, or any of numerous other materials having the desired combination of strength, weight, and cost. It is common to fit, slide, stack, or otherwise nest the articles to facilitate the automated, and often high speed, handling of large volumes of articles achieved by modern production methods. The handling of nested articles includes the counting of the articles necessary to separate a selected number of articles from the stream of nested articles into a group for packaging and distribution.

Conventional article counting techniques used in the production and packaging of nested articles are prone to produce groups of articles exhibiting more or fewer than the desired number of articles. Inaccurate counts result in economic harm to the article producer when the package contains more than the stated number of articles and economic harm to the article consumer (and potentially a loss of goodwill to the article producer) when the package contains fewer than the stated number of articles.

One conventional technique "counts" the nested articles based on the overall length of the nested dimension of the stack. This technique requires a high degree of uniformity in the number of articles per unit length of the article stream (hereinafter, the "stacking density") in order to be successful in providing an accurate and reliable count of nested articles in the stream. Because the articles to be counted often exhibit variations in stacking density along the continuous stream of nested articles, the actual number of articles in a group often varies from the desired number of articles.

Another conventional technique counts the individual articles in the article stream using optical or mechanical sensors to detect the individual articles as the stream of articles passes the sensor. FIG. 1 illustrates one version of a conventional device counting individual articles using an optical sensor. In FIG. 1, a photoemitter 1 is positioned along the path of the article stream and directs a beam of light 2 to a photoreceiver 3 along a line tangent to the article stream. As the articles move past the photoemitter/photoreceiver pair, the rims 30 interrupt the beam 2. The output of the photoreceiver 3 is by a logical unit, such as a controller, processor, or computer that records the passage of an article each time the beam 2 is interrupted. This technique relies on adequate separation between adjacent rims in the article stream, and a high degree of precision in the positioning of the sensor relative to the article stream, and a high degree of uniformity in the size and shape of the articles. It is not uncommon for these conditions to fail to occur, causing an inaccurate count the number of articles.

BRIEF SUMMARY OF THE INVENTION

A counting device for counting nested articles and associated method for counting nested articles is disclosed. The counting device for counting nested articles, or nested article counter, includes a gear adapted to be driven by a stream of nested articles. The gear defines a plurality of teeth with corresponding apertures spaced therebetween. The gear is rotationally linked to an indicator wheel, upon which is disposed a set of indicia for monitoring rotation of the indicator wheel and gear. As the indicator wheel rotates, each of the indicia is sequentially moved into alignment with a detection axis.

According to one embodiment of the present invention, each gear tooth is sized to be received within a space between adjacent rims in a stream of nested articles, and each gear aperture is sized to receive one rim therein. The indicia of the indicator wheel are spaced from one another along an annular path about the indicator wheel in correlation to the quantity and spacing of apertures between the teeth of the gear. Thus, in this embodiment, each indicia is configured to correspond to and represent one rim of the stream of nested articles. A sensor monitors the indicator wheel and produces an output signal in response to detection of the indicia moving into alignment with the detection axis, the output signal being indicative of the number of articles having driven the gear. A counter is in communication with the sensor to receive the output signal and to count the number of articles indicated by the output signal.

Another embodiment provides a first sensor for counting indicia and a second sensor for verifying continued rotation of the indicator wheel. The first sensor is positioned to observe the indicator wheel and to sense the indicia as each indicia is brought into alignment with a first detection axis. The second sensor is positioned to observe the indicator wheel and to sense the indicia as each indicia is brought into alignment with a second detection axis. The first and second detection axes are spaced apart from one another along an annular path of the indicia such that, after one indicia is brought into and out of alignment with the first detection axis to be observed by the first sensor, another indicia is brought into alignment with the second detection axis to be observed by the second sensor. Thus, the indicia cooperate to provide alternating stimuli to the first and second sensors, thus allowing the sensors to generate and communicate signals to the recording device in alternating fashion. The configuration of multiple sensors to communicate signals to the recording device in alternating fashion allows the nested article counter to perform a method for counting nested articles of the present invention. In this method, the recording device perceives a signal from a first sensor as a prompt to count a number of articles engaging the gear, and to perceive signals from subsequent sensors as an assurance that the indicator wheel has continued to rotate in relation to the sensors between subsequent signals received from the first sensor.

In another embodiment, a first set of indicia is provided spaced along a first annular path along the surface of the indicator wheel, and a second set of indicia is provided spaced along a second annular path along the surface of the indicator wheel. The first and second sensors are arranged in a stacked configuration such that the point of intersection of the first detection axis with the indicator wheel surface and the point of intersection of the second detection axis with the indicator wheel surface align along a radius from the rotational axis of the indicator wheel. In this embodiment, each of the second set of indicia is spaced evenly along said second annular path such that one of the second set of indicia aligns radially between two adjacent indicia of the first set of indicia. Thus, as the indicator wheel rotates, indicia of the first indicia set and indicia of the second indicia set are brought into alignment with cooperating first and second sensors in alternating fashion, thus allowing the sensors to generate and communicate signals to the recording device in alternating fashion.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
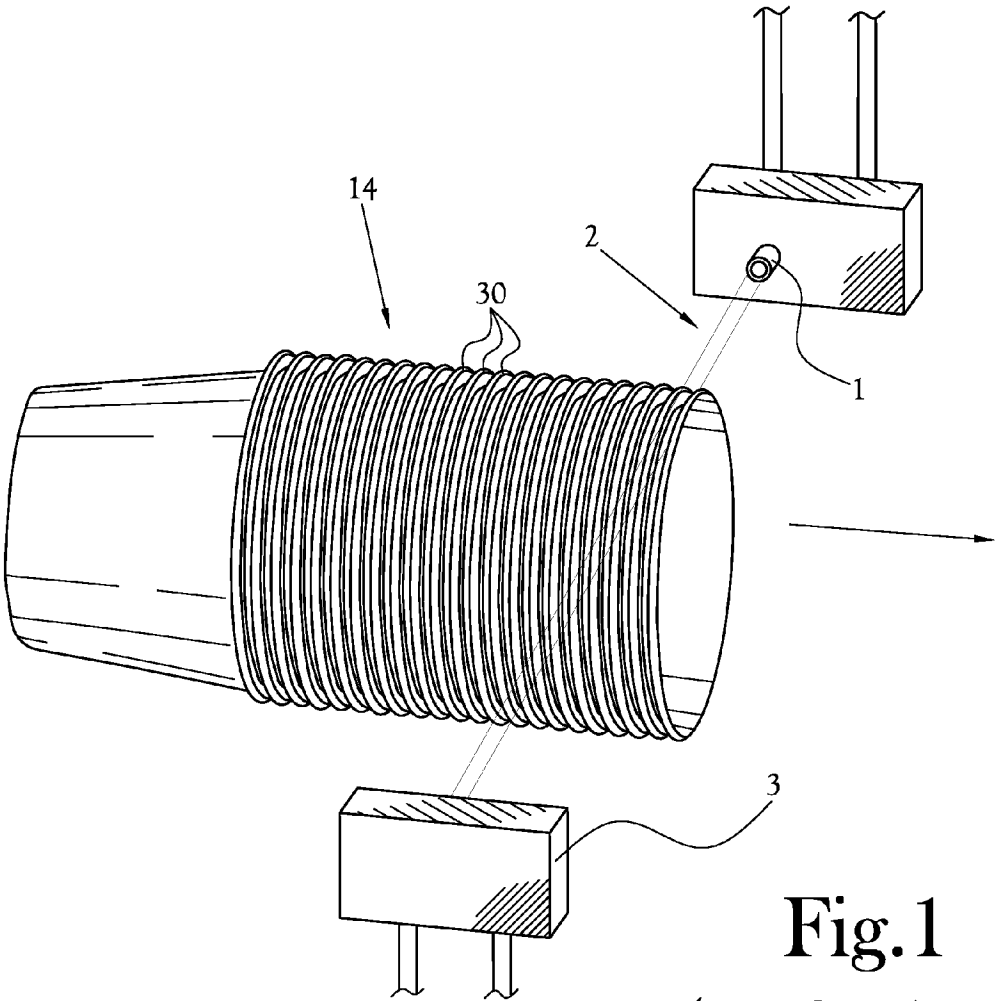
Fig.1 (PRIOR ART)
FIG. 1 is a perspective view showing a prior art method in which a photosensor directly detects rims of a continuous stream of nested articles.

A counting device for counting nested articles and associated method for counting nested articles is disclosed. The counting device for counting nested articles, or nested article counter, is illustrated at 10 in the accompanying figures. The nested article counter 10 includes generally a gear 12 adapted to be driven by a stream of nested articles. The gear 12 is rotationally linked to an indicator wheel 16, upon which is disposed a set of indicia 18 for monitoring rotation of the indicator wheel 16 and gear 12. A sensor 20 monitors the indicator wheel 16 and produces an output signal in response to detection of the indicia 18, the output signal being indicative of the number of articles having driven the gear 12. A counter 22 is in communication with the sensor 20 to receive the output signal and to count the number of articles indicated by the output signal.

Figure 2:
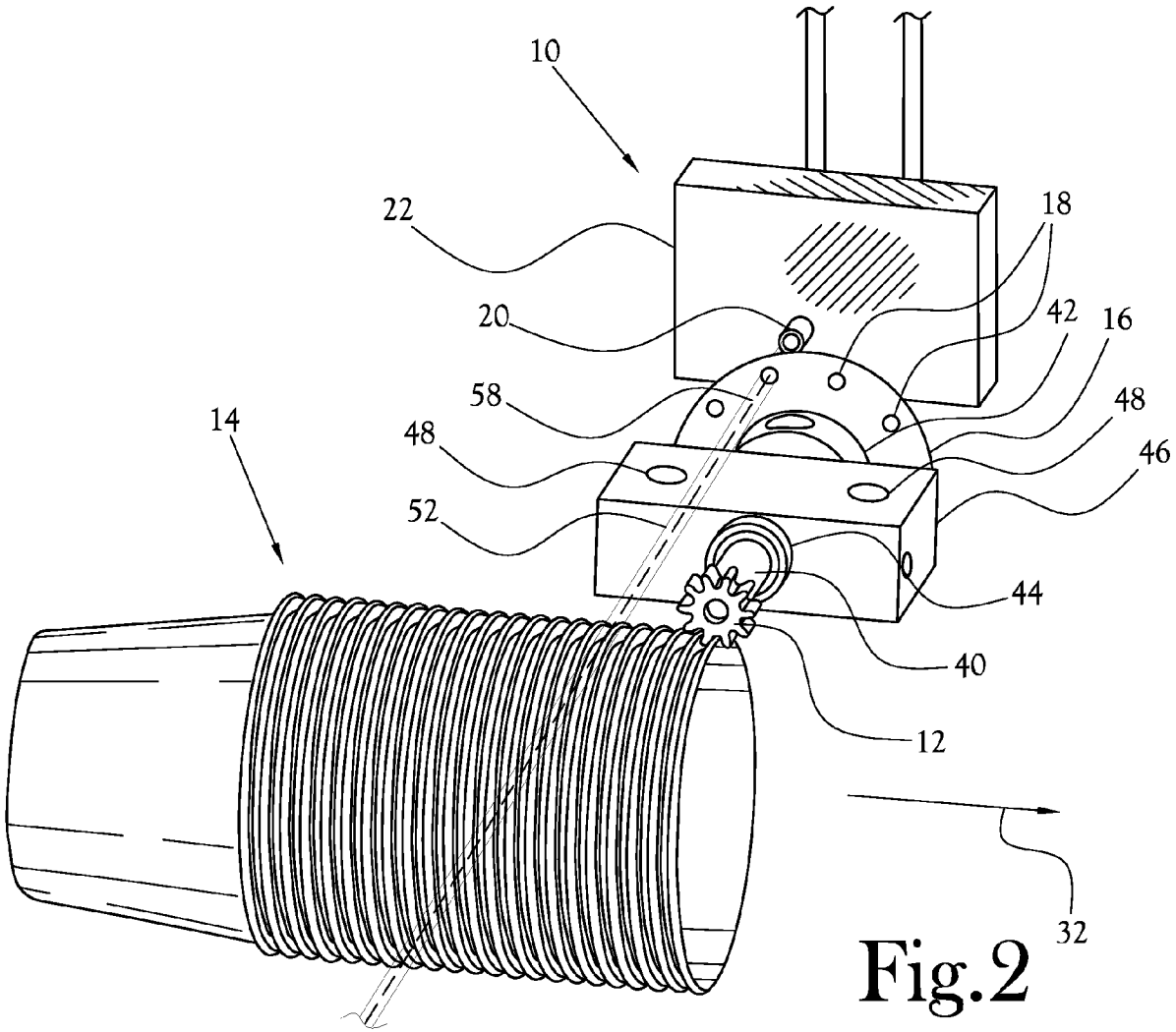
FIG. 2 is a perspective view of one embodiment of the nested article counter of the present invention.
Figure 3:
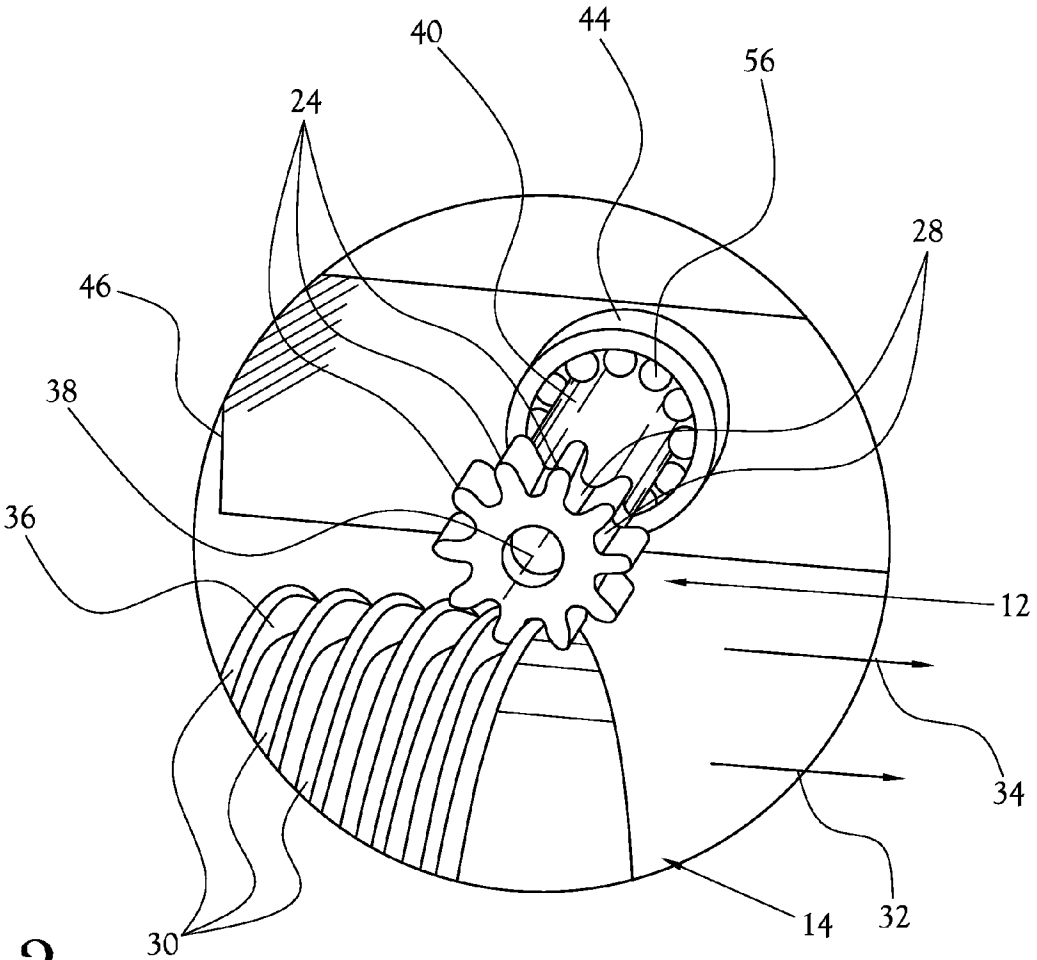
FIG. 3 is a partial perspective view showing the gear portion of the nested article counter of FIG. 2.

Referring to FIGS. 2 and 3, in one embodiment, the nested article counter 10 includes a gear 12 which is adapted to be driven by a stream of nested articles 14. The gear 12 defines a plurality of teeth 24 and corresponding apertures 28 therebetween. The teeth 24 are sized and spaced annularly about the circumference of the gear 12 so as to allow the gear 12 to engage the rims 30 of a stream of nested articles 14 as the nested articles 14 are moved along a nested direction 32 adjacent the gear 12 and parallel to a driving direction 34 of the gear 12. It is understood that the nested articles 14 are generally oriented in a nested configuration to define a linear arrangement of rims 30 along the nested direction 32, with a space 36 defined between each adjacent rim 30. Thus, each gear tooth 24 and corresponding adjacent aperture 28 is mated with a known quantity of rims 30 as the stream of nested articles 14 is moved relative to the gear 12 along the nested direction 32 adjacent the gear 12 to engage and drive the gear 12.

Figure 4:
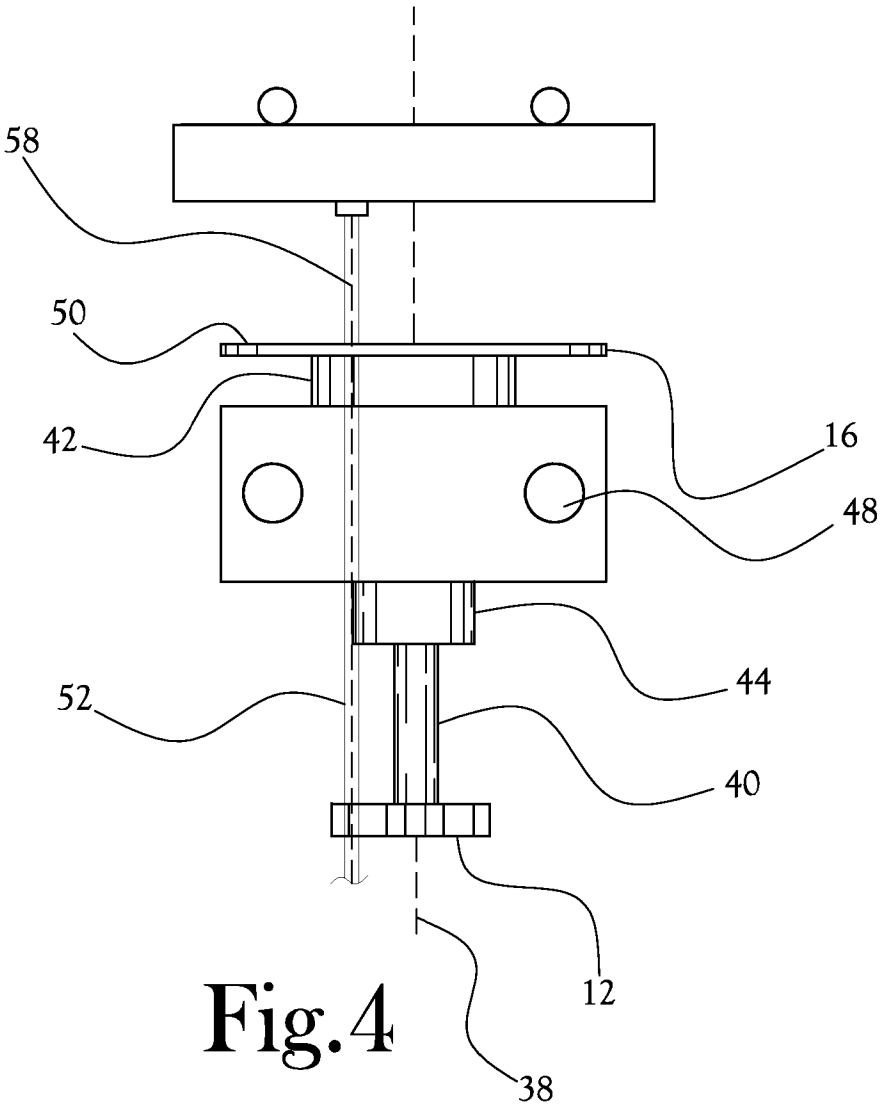
FIG. 4 is a top view of the nested article counter of FIG. 2.

FIG. 4 is a top view of the nested article counter 10 of FIG. 2. Referring to FIGS. 2 and 4, in the illustrated embodiment, the gear 12 is mechanically linked to an indicator wheel 16 and such that the indicator wheel 16 rotates as the gear 12 is rotated by the stream of nested articles 14. In the illustrated embodiment, an axle 40 is fixed between the gear 12 and the indicator wheel 16 along a common rotational axis 38 of the gear 12 and the indicator wheel 16. More specifically, in the illustrated embodiment a coupling 42 is provided to fix the indicator wheel 16 proximate one end of the axle 40, and the other end of the axle 40 is fixed proximate the gear 12 by way of an integral connection. Thus, the indicator wheel 16 is rotationally fixed in relation to the gear 12.

Referring to FIG. 3, the axle 40 is carried within a bushing 44 defined by a mounting block 46. Suitable bearings 56 are provided between the bushing 44 and the axle 40 to allow low resistance to rotation of the axle 40 about the axis 38 within the mounting block 46, thereby allowing movement of the stream of nested articles 14 to freely and easily rotate the gear 12 and indicator wheel 16 assembly. In one embodiment, suitable apparatus is carried within the bushing 44 to limit rotation of the axle 40 to a single direction corresponding to the driving direction 34 of the gear 12. The mounting block 46 further defines suitable connective apparatus 48 to allow the mounting block 46 to be mounted to a suitable support structure (not shown). In another embodiment, suitable indirect mechanical linkage is provided between the gear 12 and the indicator wheel 16 such that the indicator wheel 16 rotates as the gear 12 is rotated by the stream of nested articles 14.

Figure 5:
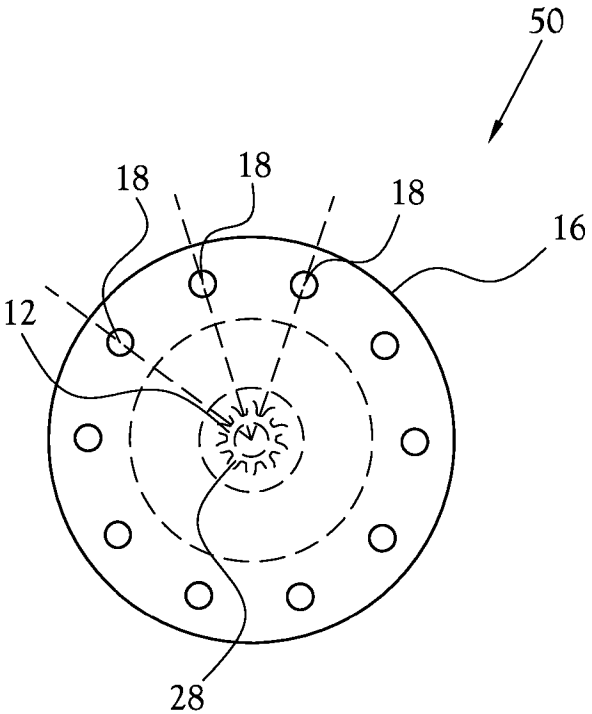
FIG. 5 is an elevation view showing the rear surface of the indicator wheel portion of the nested article counter of FIG. 2.

FIG. 5 is a side elevation view of the rear surface 50 of the indicator wheel 16 of the present embodiment of the nested article counter 10. Referring to FIG. 5, the indicator wheel 16 defines a plurality of indicia 18 disposed about the rear surface 50 of the indicator wheel 16 in an evenly spaced annular configuration. In the illustrated embodiment, the indicia 18 are spaced from one another about the indicator wheel 16 in correlation to the quantity and spacing of the apertures 28 between the gear teeth 24 of the gear 12. Referring again to FIG. 2, as the indicator wheel 16 rotates, each of the indicia 18 is sequentially moved into alignment with a detection axis 58. Each indicia 18 moving into alignment with the detection axis 58 corresponds to a given number of rims 30 having engaged the gear 12 to drive the gear 12, thereby driving the indicator wheel 16, as the stream of nested articles 14 moves relative to the gear 12. In the illustrated embodiment, one indicia 18 is provided for each gear aperture 28, and each indicia 18 is disposed along the indicator wheel 18 to align radially with a cooperating aperture 28 of the gear 16. In this embodiment, in which each gear aperture 28 is sized to receive one rim 30, each indicia 18 is configured to correspond to and represent one rim 30 of the stream of nested articles 14.

As shown in FIG. 2, a sensor 20 is mounted proximate the indicator wheel 16 and is positioned to sense the indicia 18 as each indicia 18 is brought into alignment with the detection axis 58. In this configuration, as the indicia 18 sequentially move into and then out of alignment with the detection axis 58, the sensor 20 detects and generates a signal in response to each indicia 18 passing the detection axis 58. It will be understood that the indicia 18 carried by the indicator wheel 16 are selected to signal the sensor 20, and thus, the type of indicia 18 selected depends upon the type of sensor 20 employed. In one embodiment, the sensor 20 is defined by an optical sensor. For example, in the illustrated embodiment, the sensor 20 is defined by a combination photosensor having a photoemitter portion adapted to project a beam of light 52, and a photoreceiver portion adapted to detect at least a portion of the beam of light 52 reflected from a reflective surface. In this embodiment, each indicia 18 consists of a through opening defined by the indicator wheel 16. In another embodiment, each indicia 18 consists of a light absorptive surface region of the indicator wheel 16. In both embodiments, when no indicia 18 is aligned with the detection axis 58, the beam 52 reaches the indicator wheel 16 and at least a portion of the beam 52 is reflected from the surface 50 of the indicator wheel 16 toward the photoreceiver portion of the sensor 20. At least a portion of the reflection of the beam 52 from the indicator wheel 16 is detected by the photoreceiver portion of the sensor 20 to define a first condition of the sensor 20. When the indicator wheel 16 rotates such that an indicia 18 is brought into alignment with the detection axis 58, the beam 52 fails to reflect from the surface 50 of the indicator wheel 16 toward the photoreceiver portion of the sensor 20. Insufficient detection by the photoreceiver portion of the sensor 20 of the reflection of the beam 52 from the indicator wheel 16 defines a second condition of the sensor 20, thus defining a signal produced by the sensor 20.

Figure 6:
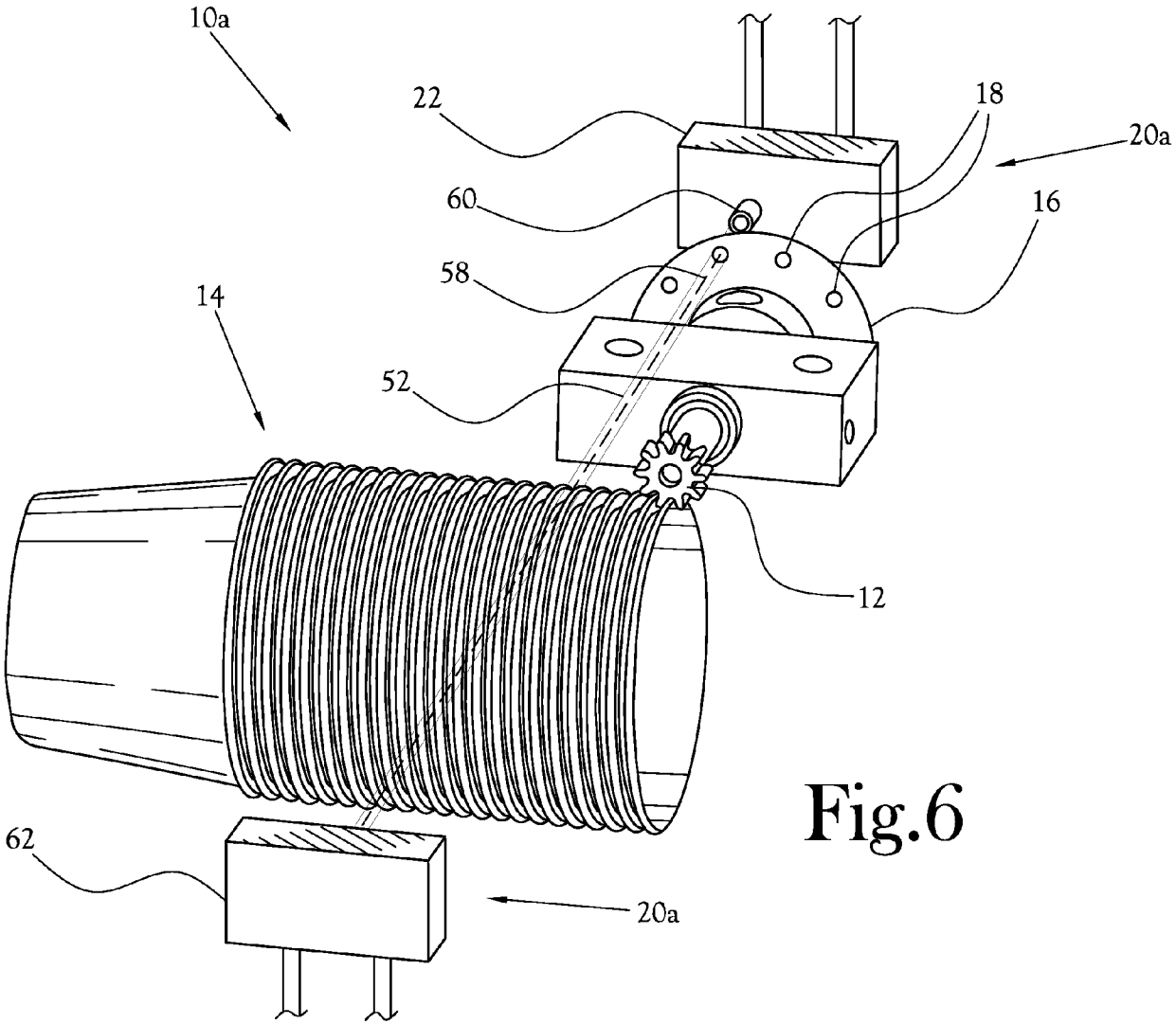
FIG. 6 is a perspective view of another embodiment of the nested article counter of the present invention.

FIG. 6 is a perspective view showing another embodiment of the nested article counter 10*a*. In the embodiment of FIG. 6, the sensor 20*a* is defined by a photoemitter 60 which is positioned on one side of the indicator wheel 16 and a photoreceiver 62 which is positioned on the opposite side of the indicator wheel 16 in alignment along the detection axis 58 to receive and sense a beam 52 generated by the photoemitter 60. The each indicia 18 is defined by a portion of the indicator wheel 16 which is transparent to at least a portion of the beam 52, such as a through opening 18 defined by the indicator wheel 16. In this embodiment, when no through opening 18 is positioned along the path of the beam 52, the indicator wheel 16 is interposed between the photoemitter 60 and the photoreceiver 62 to prevent the beam 52 from reaching and being detected by the photoreceiver 62. The photoreceiver 62 fails to sense the beam 52, thereby defining a first condition of the sensor 20*a*. However, when a through opening 18 aligns with the beam 52, the beam 52 travels through the through opening 18 and reaches the photoreceiver 62. The photoreceiver 62 detects the beam 52 to define a second condition of the sensor 20*a*.

In other embodiments, other types of indicia sensors with appropriate indicia 18 may be used to accomplish the present invention. For example, in one embodiment, each indicia 18 is defined by a raised portion of the surface 50 of the indicator wheel 16, while the sensor 20 is defined by a proximity sensor which is configured to sense the raised indicia 18 as each indicia 18 is brought into proximity with the sensor 20. In another embodiment, the sensor 20 is defined by a magnetic sensor, while each indicia 18 is defined by a magnetic material. The magnetic sensor is configured to sense the magnetic indicia as each indicia passes the detection axis 58. Those skilled in the art will recognize other combinations of sensors and indicia which may be used without departing from the spirit and scope of the present invention.

In each of the above-discussed embodiments, the gear teeth 24 are sized so as to allow one gear tooth 24 to fit within each space 36 between immediately adjacent rims 30 in the stream of nested articles 14. Likewise, the gear teeth 24 are spaced about the gear 12 so as to allow one rim 30 to fit within each aperture 28 between each of the gear teeth 24. In this embodiment, as the stream of nested articles 14 moves along the nested direction 32 in engagement with the gear 12, each rim 30 in the stream of nested articles 14 engages one tooth 24 of the gear 12 to turn the gear 12 about its axis 38. Also, in each of the above-discussed embodiments, one indicia 18 is provided along the indicator wheel 16 for each aperture 28 between the gear teeth 24 of the gear 12. Thus, in each of the above-discussed embodiments, each indicia 18 represents one article having driven the gear 12. In other embodiments, the ratio of gear apertures 28 to articles engaging the gear 12, and the ratio of indicia 18 to apertures 28, varies. For example, in one embodiment, the gear teeth 24 are sized and spaced about the gear 12 relative to the rims 30 and corresponding spaces 36 such that a plurality of rims 30 fit within each aperture 28 between each of the gear teeth 24. In yet another embodiment, the gear teeth 24 are sized and spaced about the gear 12 relative to the rims 30 and corresponding spaces 36 such that a plurality of gear teeth 24 fit within each space 36 between immediately adjacent rims 30 in the stream of nested articles 14.

In certain embodiments, a number of indicia 18 equal to the mathematical product of the number of gear apertures 28 by the number of rims 30 fitting within each gear aperture 28 is provided. In one embodiment, in which the gear teeth 24 are sized and spaced about the gear 12 such that a plurality of rims 30 fit within each gear aperture 28, a number of indicia 18 equal to the number of rims 30 fitting within each gear aperture 28 is provided for each gear aperture 28. In another embodiment, in which the gear teeth 24 are sized and spaced about the gear 12 such that a plurality of gear teeth 24 fit within each space 36 between immediately adjacent rims 30 in the stream of nested articles 14, a number of indicia 18 is provided equal to the number of rims 30 which engage the gear 12 to drive the gear 12 in one complete revolution about the gear axis 38. In each of the aforementioned embodiments, the indicia are spaced about the surface 50 of the indicator wheel 16 in the annular configuration such that each indicia 18 is configured to correspond to one rim 30 of the stream of nested articles 14. In another embodiment, a single indicia 18 is provided. In this embodiment, the single indicia 18 corresponds to a number of rims 30 equal to the total number of rims 30 which engage the gear 12 to drive the gear 12 in one complete revolution about the gear axis 38. It will be understood that other ratios of indicia 18 to rims 30 can be used without departing from the spirit and scope of the present invention.

Figure 7:
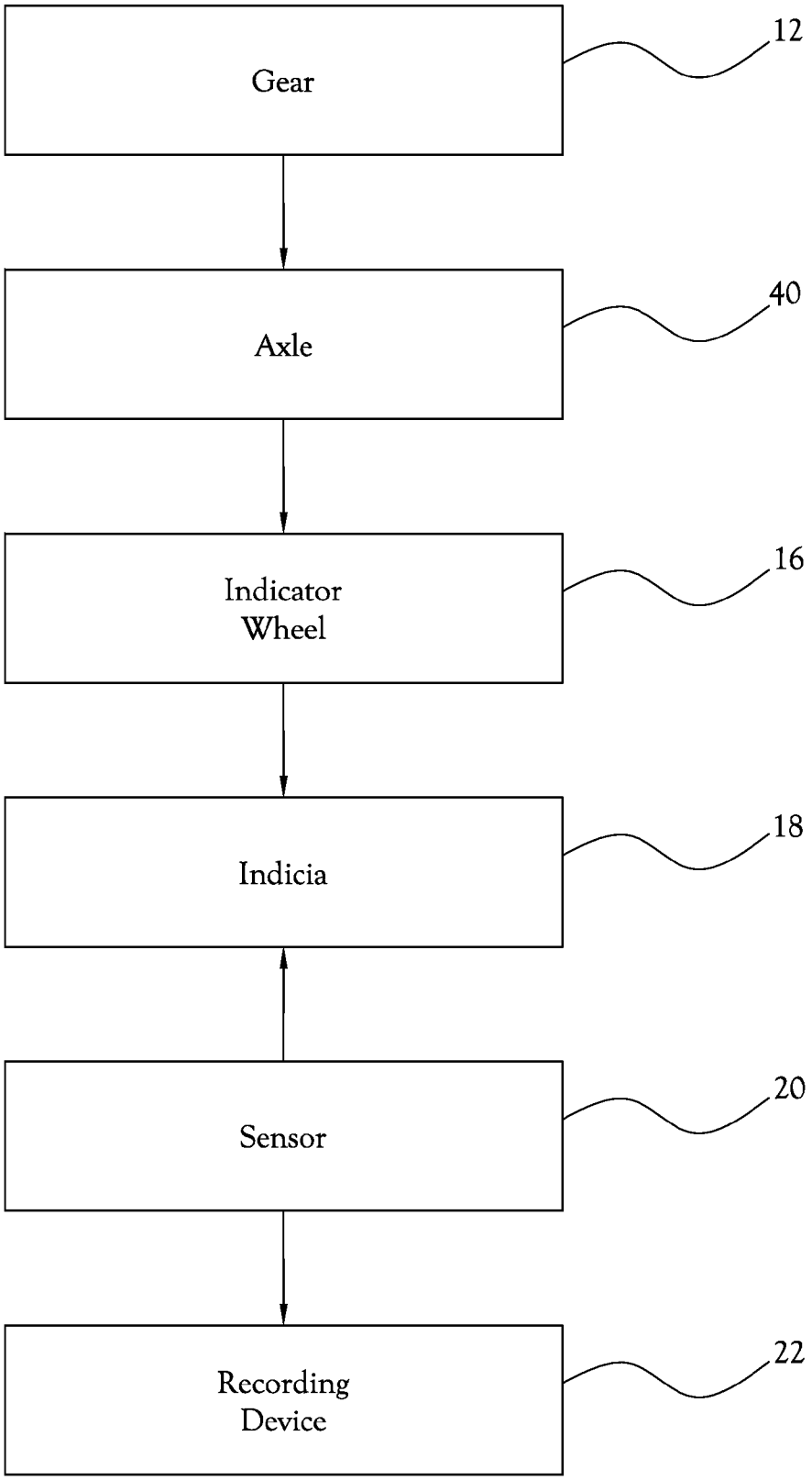
FIG. 7 is a block diagram showing the interconnections of the various components of the embodiment of the nested article counter of FIG. 2.

FIG. 7 is a block diagram showing the interconnections of the various components of the embodiment of the nested article counter 10 of FIG. 2. As discussed above, the indicia 18 are configured about the surface 50 of the indicator wheel 16 such that each indicia 18 corresponds to a given number of rims 30 moving past the gear 12 in engagement with the gear teeth 24. Referring to FIG. 7, the sensor 20 is configured to generate a signal in response to each indicia 18 moving sequentially into alignment with the detection axis 58. Thus, each signal generated by the sensor 20 in response to each indicia 18 also corresponds to the given number of rims 30 moving past the gear 12 in engagement with the gear teeth 24. The sensor 20 is in communication with a recording device 22, such as a computing device, to communicate the signal to the recording device 22. The recording device 22, in response to the signal received from the sensor 20, records the given number of article rims 30 corresponding to each signal generated by the sensor 20. It will be understood that suitable apparatus is provided such that the number of article rims 30 recorded by the recording device 22 is usable by a user of the nested article counter 10.

From the foregoing description, it will be recognized by those skilled in the art that the above-described embodiments of the nested article counter 10 provide a device for reliably counting each article in a stream of nested articles 14 with a significantly reduced risk of failure to detect and count an article in the stream of nested articles 14. However, as discussed above, in use of the nested article counter 10 in certain applications, exposure of the nested article counter 10 to certain stimuli, such as shaking, jarring, vibration, or other movement common in industrial machinery, can result in temporary displacement of the indicator wheel 16 proximate the sensor 20. When such temporary displacement occurs during a time when an indicia 18 is aligned with the detection axis 58, such temporary displacement can result in temporary misalignment of the indicia 18 with the detection axis 58, followed by realignment of the same indicia 18 with the detection axis 58. Such misalignment and subsequent realignment of the same indicia 18 with the detection axis can result in a perception by the sensor 20 that multiple indicia 18 have traveled into and out of alignment with the detection axis 58, thus causing the sensor 20 to provide multiple signals the recording device 22, and thereby resulting in the recording device 22 inaccurately recording multiple instances of the given number of article rims 30 corresponding to each signal generated by the sensor 20 as having passed the gear 12, rather than a single instance corresponding to the one indicia 18 perceived multiple times by the sensor 20. In order to limit this phenomenon, in certain embodiments, a plurality of sensors 20 are provided to allow the recording device 22 to verify continued rotation of the indicator wheel 16 in relation to the sensors 20.

Figure 8:
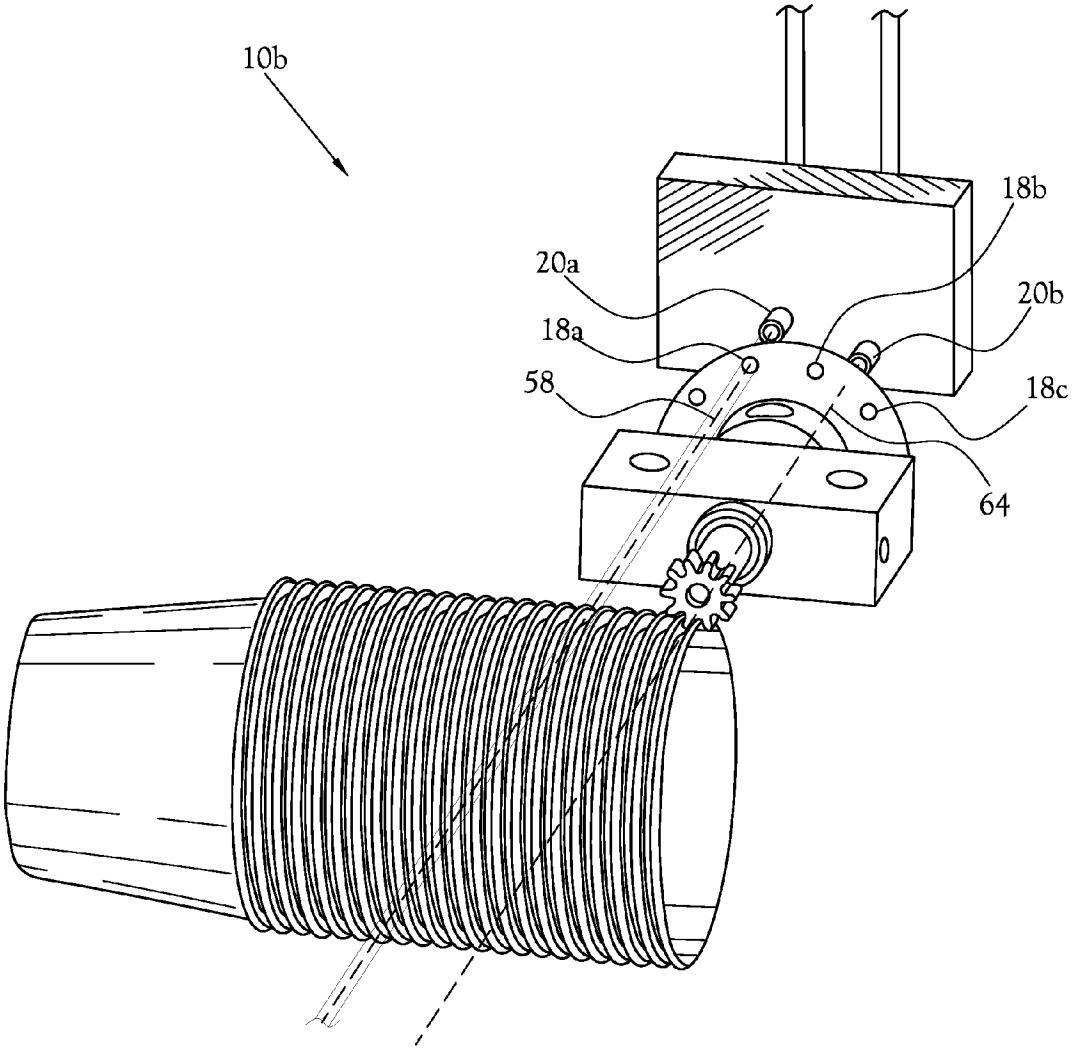
FIG. 8 is a perspective view of another embodiment of the nested article counter of the present invention, showing the first sensor detecting an indicia.
Figure 9:
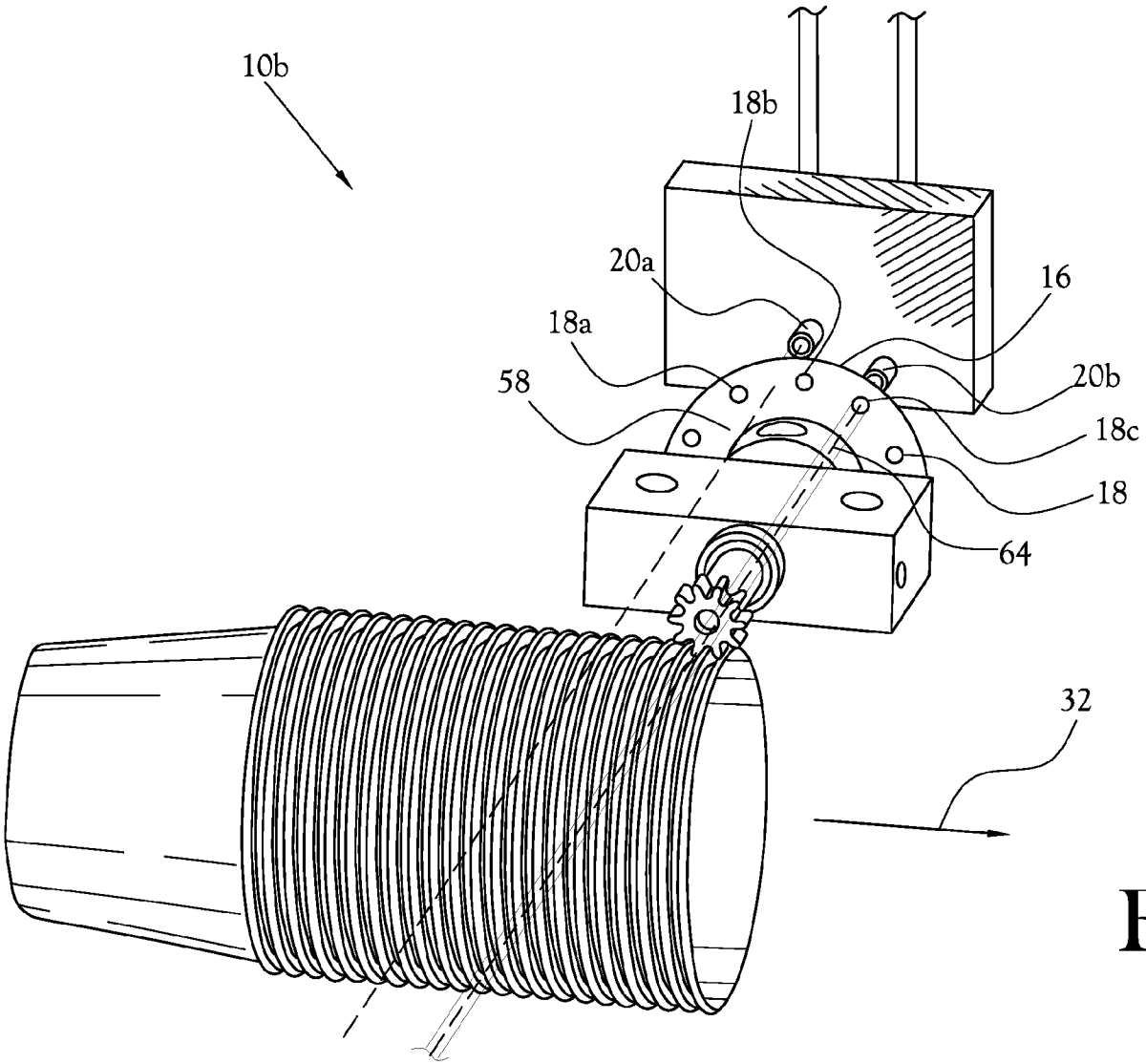
FIG. 9 is a perspective view of the embodiment of the nested article counter of FIG. 8, showing the second sensor detecting an indicia.

For example, FIGS. 8 and 9 illustrate another embodiment of the nested article counter 10*b*. In this embodiment, a first sensor 20*a* is provided for counting indicia 18 and a second sensor 20*b* is provided for verifying continued rotation of the indicator wheel 16. The first sensor 20*a* is mounted proximate the indicator wheel 16 and is positioned to observe the indicator wheel 16 and to sense the indicia 18 as each indicia 18 is brought into alignment with a first detection axis 58. The second sensor 20*b* is mounted proximate the indicator wheel 16 and is positioned to observe the indicator wheel 16 and to sense the indicia 18 as each indicia 18 is brought into alignment with a second detection axis 64. The first and second detection axes 58, 64 are spaced apart from one another along the annular path of the indicia 18 such that, after one indicia 18*a* is brought into and out of alignment with the first detection axis 58 to be observed by the first sensor 20*a*, another indicia 18*b* is brought into alignment with the second detection axis 64 to be observed by the second sensor 20*b*.

In several embodiments, the first and second detection axes 58, 64 are spaced apart from one another along the annular path of the indicia 18 by a distance equal to a multiple of approximately 0.5 times the distance between adjacent indicia 18 along the annular path of the indicia 18. For example, in the illustrated embodiment, ten indicia 18 are provided in an evenly-spaced configuration about the annular path of the indicia 18, and thus, each indicia is spaced center-to-center at a distance corresponding to a 36 degree arc along the annular path of the indicia 18. The first and second detection axiss 58, 64 are spaced center-to-center at a distance corresponding to a 54 degree arc along the annular path of the indicia 18, in other words, 1.5 times the spacing of the indicia 18. As shown in FIG. 8, in this embodiment, as the indicator wheel 16 rotates, a first indicia 18*a* is brought into alignment with the first detection axis 58 and is sensed by the first sensor 20*a*. A second indicia 18*b* is disposed along the annular path of the indicia 18 between the first and second detection axiss 58, 64. Referring to FIG. 9, after the first indicia 18*a* moves out of alignment with the first detection axis 58, a third indicia 18*c* is brought into alignment with the second detection axis 64 and is sensed by the second sensor 20*b*. The third indicia 18*c* then proceeds out of alignment with the second detection axis 64, and thereafter the second indicia 18*b* is brought into alignment with the first detection axis 58 to be sensed by the first sensor 20*a*, and so forth. Thus, the indicia 18 cooperate to provide alternating stimuli to the first and second sensors 20*a*, 20*b*, thus allowing the sensors to generate and communicate signals to the recording device 22 in alternating fashion.

Figure 10:
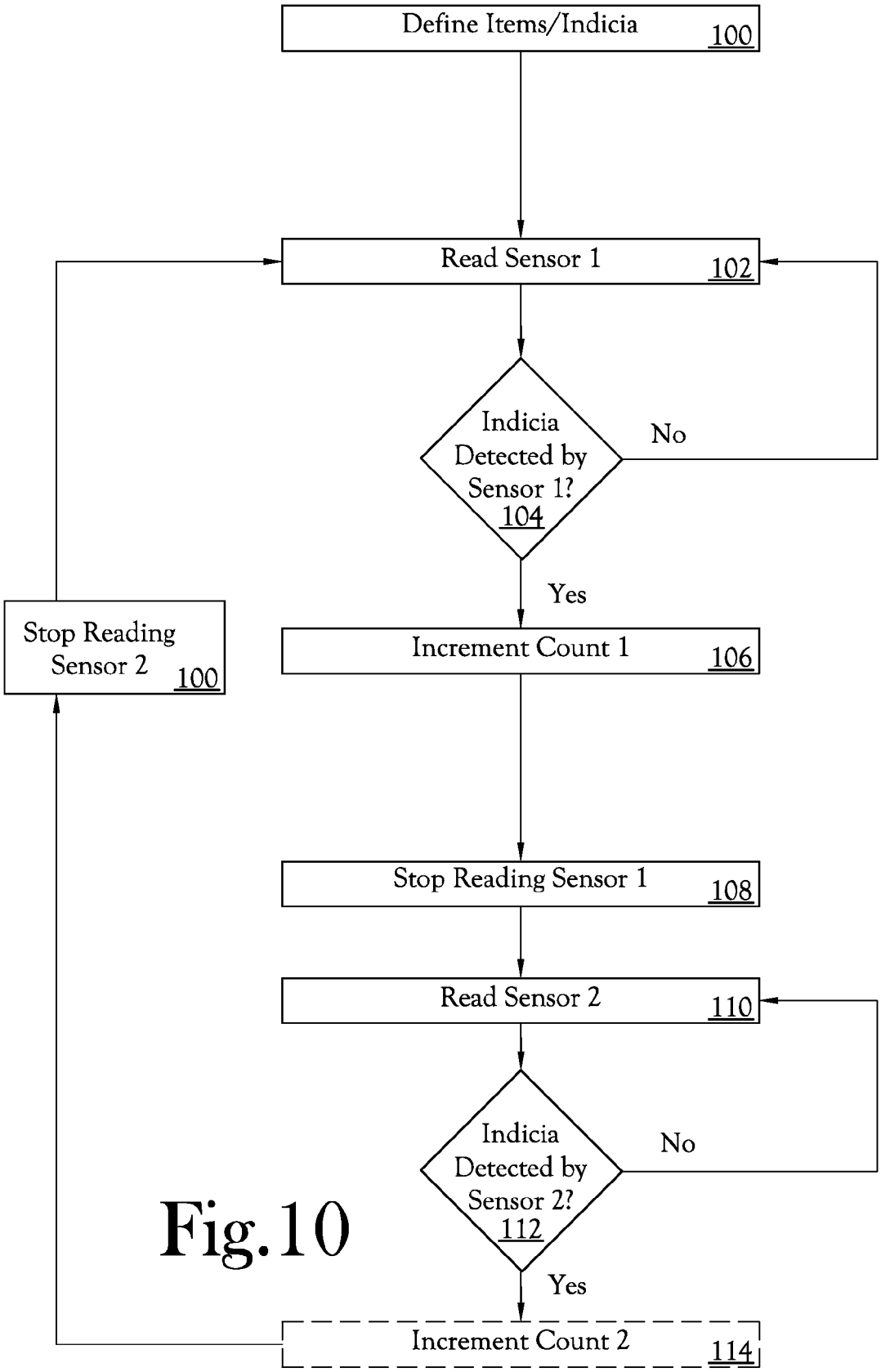
FIG. 10 is a flow chart showing a method for counting nested articles of the present invention.

The configuration of multiple sensors 20*a*, 20*b* to communicate signals to the recording device 22 in alternating fashion allows the nested article counter 10*b* to perform a method for counting nested articles of the present invention. In this method, the recording device 22 perceives a signal from a first sensor 20*a* as a prompt to count a number of articles engaging the gear 12, and to perceive signals from subsequent sensors 20*b* as an assurance that the indicator wheel 16 has continued to rotate in relation to the sensors 20*a*, 20*b* between subsequent signals received from the first sensor 20*a*. For example, FIG. 10 is a flow diagram illustrating the method of operation of the nested article counter 10*b* of the present embodiment. As shown in FIG. 10, in an initial step, the number of article rims 30 represented by each indicia 18 is defined 100 by the recording device 22. The recording device 22 begins 102 to read the first sensor 20*a* and to await the receipt of a signal 104 indicating the detection of an indicia 18 aligned with the first detection axis 58 by the first sensor 20*a*. If no indicia 18 is detected by the first sensor 20*a*, the recording device 22 continues to read 102 the first sensor 20*a*. Once the recording device 22 receives a signal from the first sensor 20*a* indicating that the first sensor 20*a* has detected an indicia 18 aligned with the first detection axis 58, the recording device 22 records 106 the given number of article rims 30 corresponding to each indicia 18. The recording device 22 then discontinues reading 108 the first sensor 20*a*. The recording device 22 begins to read 110 the second sensor 20*b* and to await the receipt of a signal 112 indicating the detection of an indicia 18 aligned with the second detection axis 64 by the second sensor 20*b*. If no indicia 18 is detected by the second sensor 20*a*, the recording device 22 continues to read the second sensor 20*a*. Once the recording device 22 receives a signal from the second sensor 20*a* indicating that the second sensor 20*a* has detected an indicia 18 aligned with the second detection axis 64, the recording device 22 discontinues reading 116 the second sensor 20*b* and resumes reading the first sensor 20*a*. In this manner, once a signal is received by the recording device 22 from the first sensor 20*a* indicating that the first sensor 20*a* has detected an indicia 18 aligned with the first detection axis 58 and the recording device 22 records the given number of article rims 30 corresponding to the detected indicia 18, the recording device 22 is discouraged from recording detection of the same indicia 18 until the indicator wheel 16 completes a full rotation to bring the indicia 18 back around to the first detection axis 58.

Figure 11:
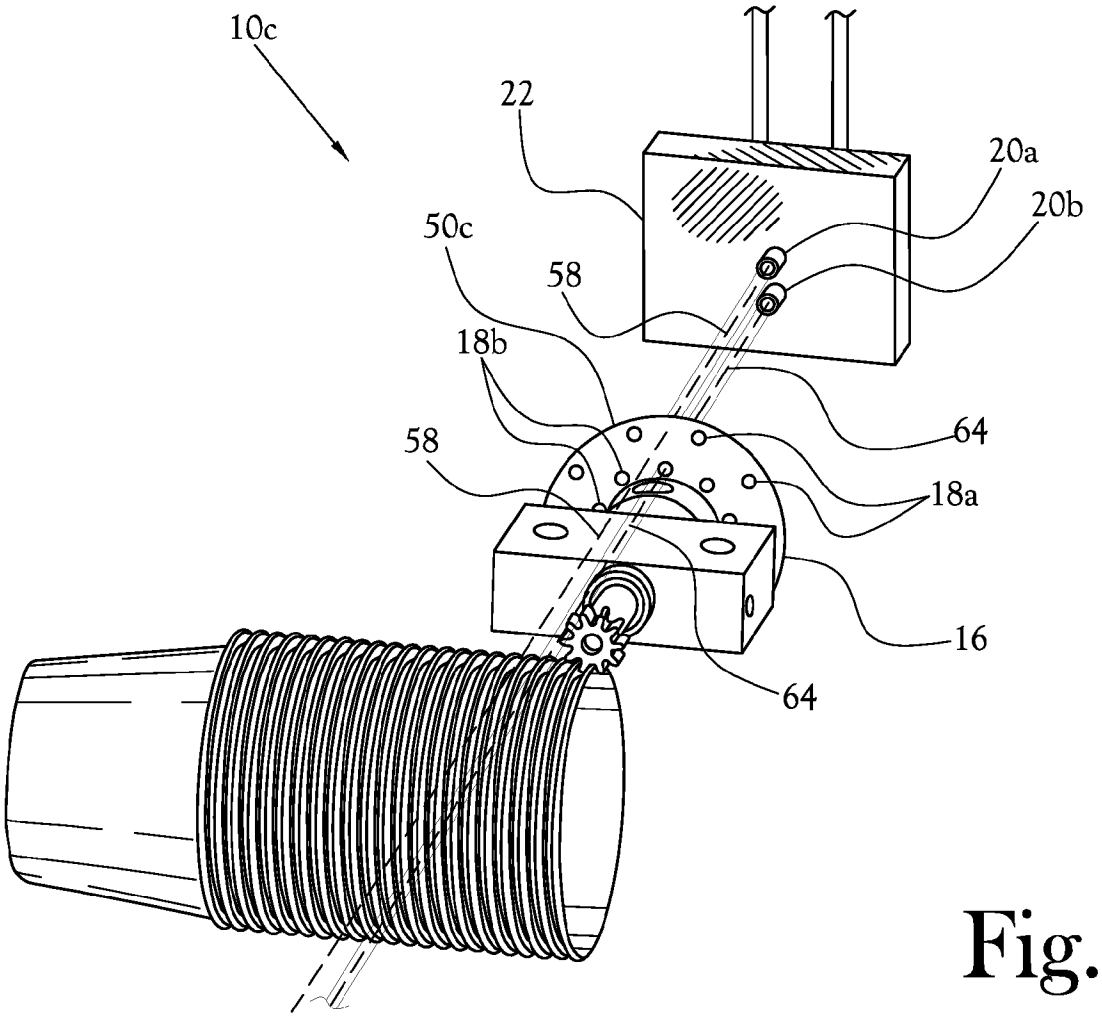
FIG. 11 is a perspective view of another embodiment of the nested article counter of the present invention.
Figure 12:
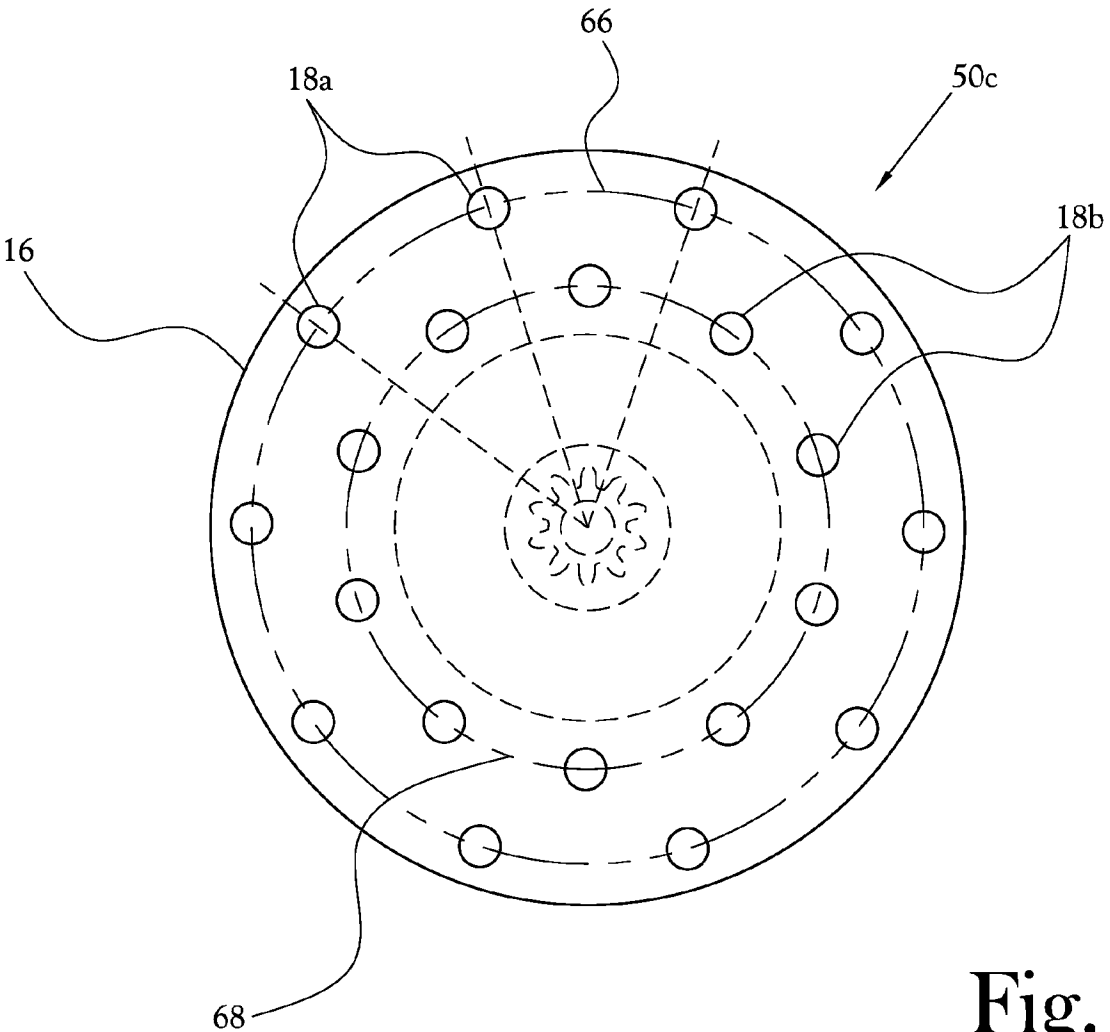
FIG. 12 is an elevation view showing the rear surface of the indicator wheel portion of the nested article counter of FIG. 11.

It will be understood that other configurations of indicia 18 about the surface 50 of the indicator wheel 16 can be used to provide alternating stimuli to the first and second sensors 20*a*, 20*b*, thus allowing the sensors to generate and communicate signals to the recording device 22 in alternating fashion. For example, in the embodiment of the nested article counter 10*c* shown in FIGS. 11 and 12, a first set of indicia 18*a* is provided spaced along a first annular path 66 along the surface 50 of the indicator wheel 16, and a second set of indicia 18*b* is provided spaced along a second annular path 68 along the surface 50 of the indicator wheel 16. The first and second sensors 20*a*, 20*b* are arranged in a stacked configuration such that the point of intersection of the first detection axis 58 with the indicator wheel surface 50 and the point of intersection of the second detection axis 64 with the indicator wheel surface 50 align along a radius from the rotational axis of the indicator wheel 16. The first and second annular paths 66, 68 are substantially concentric with the rotational axis of the indicator wheel 16, such that the first detection axis 58 corresponding to the first sensor 20*a* remains in intersection with the first annular path 66, while the second detection axis 64 corresponding to the second sensor 20*b* remains in intersection with the second annular path 66. In this embodiment, each of the first set of indicia 18*a* is spaced evenly along the first annular path 66 to correspond with and represent the number of articles engaged by each gear tooth 24 and corresponding aperture 28. Each of the second set of indicia 18*b* is spaced evenly along said second annular path such that one of the second set of indicia 18*b* aligns radially between two adjacent indicia of the first set of indicia 18*a*. Thus, as the indicator wheel 16 rotates, indicia of the first indicia set 18*a* and indicia of the second indicia set 18*b* are brought into alignment with cooperating first and second sensors 20*a*, 20*b*, in alternating fashion, thus allowing the sensors to generate and communicate signals to the recording device 22 in alternating fashion.

From the foregoing description, it will be recognized by those skilled in the art that a nested article counter 10 for counting nested article rims 30 and associated method for counting nested article rims 30 has been provided. The nested article counter 10 provides an accurate apparatus and method for determining the number of nested articles in a stream of nested articles and for recording the number of nested articles engaging the gear 12 within a recording device 22. It will be understood that in certain embodiments the recording device 22 is adapted to be placed in communication with an output device, such as for example a display indicating the number of articles in the stream of nested articles recorded by the recording device 22. In other embodiments, the recording device 22 is adapted to be placed in communication with conventional apparatus for interrupting the continuous flow of nested articles engaging the gear 12 in order to facilitate separation of the continuous flow of nested articles into stacks of known count content.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A counting device for counting rimmed articles arranged in a nested configuration to define a series of stacked rims defining a stacked direction, said device comprising:

a gear having a plurality of teeth adapted to engage the article rims such that advancement of the articles along the stacked direction adjacent said gear rotates said gear;

an indicator wheel configured to rotate with rotation of said gear, said indicator wheel having a plurality of indicia, said indicia for monitoring rotation of said gear, at least one set of said indicia being disposed about said indicator wheel in an annular path, said annular path intersecting a detection axis;

at least one sensor positioned to detect said indicia and to generate an output signal as said indicia are carried into alignment with said detection axis; and a counter in communication with said sensor, said counter producing a usable output in response to said output signal of said sensor, said usable output representing a quantity of articles having engaged said gear.

2. The counting device of claim 1, said gear defining a plurality of apertures, each said aperture disposed between a pair of adjacent gear teeth, each said aperture being sized to receive one article rim therein.

3. The counting device of claim 2, said plurality of indicia including one indicia disposed along said indicator wheel to correspond to each said aperture, each said indicia representing one article engaged by said gear teeth.

4. The counting device of claim 1 further including an axle fixed between said gear and said indicator wheel along a common rotational axis of said gear and said indicator wheel.

5. The counting device of claim 4 further including a mounting block adapted to be secured to a support structure, said mounting block defining a bushing, said axle being at least partially disposed within said bushing, said mounting block further including a plurality of bearings disposed between said axle and said bushing to allow rotation of said axle within said bushing.

6. The counting device of claim 1, each said indicia of said at least one set being evenly spaced along said annular path.

7. The counting device of claim 1, said at least one sensor being a photosensor.

8. The counting device of claim 7, said at least one sensor having a photoemitter portion adapted to emit a beam of light along said detection axis toward said indicator wheel, said indicator wheel being at least partially reflective of a portion of said beam of light, said sensor further having a photoreceiver portion being adapted to detect said portion of said beam of light, each said indicia being substantially non-reflective of a said portion of said beam of light.

9. The counting device of claim 8, each said indicia consisting of a through opening defined by said indicator wheel.

10. The counting device of claim 1, said at least one sensor including:

a first sensor positioned to observe along a first detection axis intersecting said annular path, said first sensor being adapted to sense said indicia and to generate a first sensor signal in response to said indicia being brought into alignment with said first detection axis; and a second sensor positioned to observe along a second detection axis intersecting said annular path, said second sensor being adapted to sense said indicia and to generate a second sensor signal in response to said indicia being brought into alignment with said second detection axis.

11. The counting device of claim 10, said counter being configured to detect said first and second sensor signals, said counter being configured to respond to a first detection of said first sensor signal by recording said quantity of articles represented by said sensed indicia and discontinuing response to subsequent detection of said first sensor signal, said counter being configured to respond to detection of said second sensor signal by resuming response to detection of said first sensor signal.

12. The counting device of claim 11, each said indicia being evenly spaced along said annular path, said intersection of said first detection axis with said annular path and said intersection of said second detection axis with said annular path being spaced apart from one another along said annular path by a distance equal to a non-integer multiple of said spacing of said indicia.

13. The counting device of claim 12, said intersection of said first detection axis with said annular path and said intersection of said second detection axis with said annular path being spaced apart from one another along said annular path by a distance equal to an integer multiple of 0.5 times the distance of said spacing of said indicia along said annular path.

14. A counting device for counting rimmed articles arranged in a nested configuration to define a series of stacked rims defining a stacked direction, said device comprising:

a gear having a plurality of teeth adapted to engage said rims such that advancement of said rims along said stacked direction adjacent said gear rotates said gear;

an indicator wheel configured to rotate in response to rotation of said gear, said indicator wheel carrying a plurality of indicia thereon, at least a first portion of said indicia being disposed about said indicator wheel in a first annular path, each said indicia of said first portion representing a quantity of articles engaged by said gear teeth, said first annular path intersecting a first detection axis, at least a second portion of said indicia being disposed about said indicator wheel in a second annular path, said second annular path intersecting a second detection axis;

a first sensor configured to sense and respond to said indicia brought into alignment with said first detection axis and a second sensor configured to sense and respond to said indicia brought into alignment with said second detection axis; and a recording device in communication with said first and second sensors, said recording device being configured to detect said responses of said first and second sensors, said recording device being configured to respond to a first detection of said first sensor response by recording said quantity of articles represented by said sensed indicia and discontinuing response to subsequent detection of first sensor responses, said recording device being configured to respond to detection of said second sensor signal by resuming response to detection of said first sensor responses.

15. The counting device of claim 14, said first and second annular paths being concentric, each said first portion of said indicia being evenly spaced about said first annular path and each said second portion of said indicia being evenly spaced about said second annular path.

16. The counting device of claim 15, each said indicia of said second portion being disposed along said second annular path radially between adjacent indicia of said first portion along said first annular path.

17. The counting device of claim 14, each said first and second sensor being a photosensor.

18. The counting device of claim 17, each said first and second sensor having a photoemitter portion adapted to emit a beam of light along said cooperating detection axis toward said indicator wheel, said indicator wheel being at least partially reflective of a portion of said beam of light, each said sensor further having a photoreceiver portion being adapted to detect said portion of said beam of light, each said indicia being substantially non-reflective of a said portion of said beam of light.

19. The counting device of claim 18, each said indicia consisting of a through opening defined by said indicator wheel.

20. The counting device of claim 14, said gear defining a plurality of apertures, each said aperture disposed between a pair of adjacent gear teeth, each said aperture being sized to receive one article rim therein, said first portion of indicia including one indicia disposed along said indicator wheel to correspond to each said aperture, each said indicia of said first portion representing one article engaged by said gear teeth.

* * * * *